United States Patent [19]

Dluhosch

[11] 4,364,352

[45] Dec. 21, 1982

[54] CARBURETOR CONTROL ARRANGEMENT FOR INTERNAL COMBUSTION ENGINE

[75] Inventor: Kurt Dluhosch, Schweinfurt, Fed. Rep. of Germany

[73] Assignee: Fichtel & Sachs AG, Schweinfurt, Fed. Rep. of Germany

[21] Appl. No.: 212,575

[22] Filed: Dec. 3, 1980

[30] Foreign Application Priority Data

Dec. 12, 1979 [DE] Fed. Rep. of Germany ... 7934941[U]

[51] Int. Cl.[3] ..... F02D 31/00; F02D 9/08

[52] U.S. Cl. ..... 123/376; 123/403; 123/323; 123/337

[58] Field of Search ..... 123/376, 403, 337, 323, 123/73 V, 73 SP, 73 R, 73 A, 74 R, 74 A, 65 PE, 65 V

[56] References Cited

U.S. PATENT DOCUMENTS

| | | | |
|---|---|---|---|
| 1,336,232 | 4/1920 | Isliker | 123/73 V |
| 2,440,483 | 4/1948 | Mennesson | 123/65 V |
| 3,028,848 | 4/1962 | Catterson | 123/376 |
| 3,149,618 | 9/1964 | Catterson | 123/376 |
| 4,237,831 | 12/1980 | Noguchi et al. | 123/73 A |
| 4,285,311 | 8/1981 | Ito | 123/323 |

FOREIGN PATENT DOCUMENTS 872690 7/1961 United Kingdom .

*Primary Examiner*—Wendell E. Burns

*Attorney, Agent, or Firm*—Toren, McGeady & Stanger

[57] ABSTRACT

In an internal combustion engine with a carburetor control device, a throttle valve of the carburetor is arranged in the intake port which is defined by the cylinder block of the engine and a control linkage is established between the crankshaft and the throttle valve in order to control the speed of the throttle valve in accordance with a set value. The connection linkage is arranged in the interior of the crankcase and extends completely within the cylinder block and the crankcase interior.

3 Claims, 1 Drawing Figure

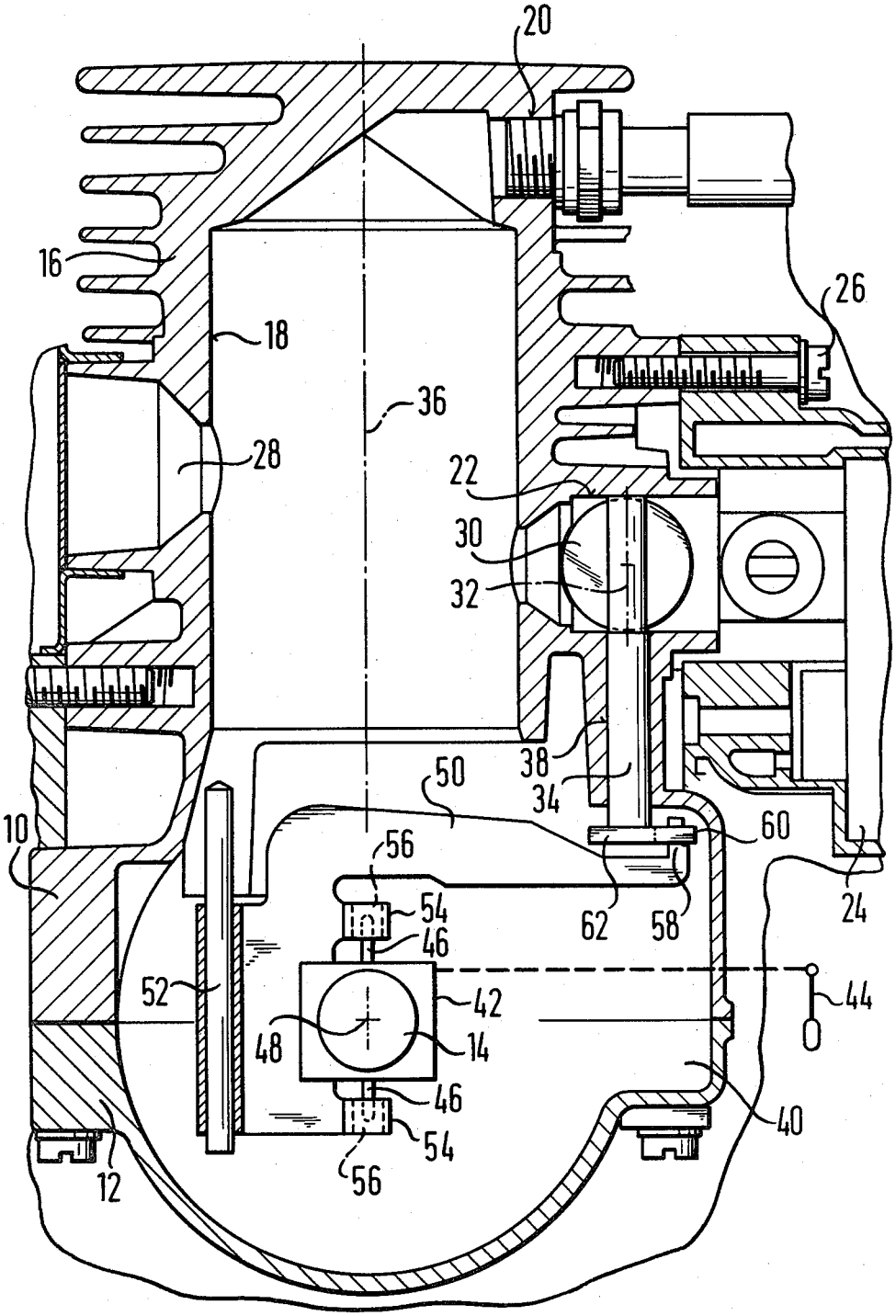
20
16
18
26
36
28
22
30
32
38
34
50
60
10
56
54
46
62
58
24
52
42
44
48
14
46
40
54
56
12

CARBURETOR CONTROL ARRANGEMENT FOR INTERNAL COMBUSTION ENGINE

The present invention relates generally to internal combustion engines and more particularly to an internal combustion engine which includes a carburetor and a control mechanism for the throttle valve of the carburetor.

More specifically, the invention relates to a device where a preset speed of the engine may be obtained by comparing crankshaft speed with a set speed and controlling the carburetor throttle valve in accordance with the sensed difference.

In internal combustion engines having carburetors mounted therein, the throttle valve of the carburetor is conventionally arranged within the carburetor itself. Alternatively, a connection may also be provided between the engine cylinder and the carburetor. When an internal combustion engine equipped in this manner is used for stationary operation which would generally require that a separate control be used, the corresponding adjusting elements must be guided from the crankcase to the shaft of the throttle valve. However, in such an arrangement it may cause impairment to daily operation of the engine or possibly to operation in rugged areas that the control linkage may become dirty or even possibly damaged. Moreover, due to the influence of dust, the bearing of the throttle valve shaft may be worn prematurely.

Although premature wear of the valve shaft may be essentially eliminated by a separate cover or by enlarging the carburetor housing, there is nevertheless the disadvantage that, if it should become necessary to disassemble the carburetor, the control linkage for actuating the throttle valve must also be readjusted.

The innovation of the present invention is based upon the task of improving a carburetor internal combustion engine of the generic type with regard to the aforementioned disadvantages and difficulties arising in prior art devices.

SUMMARY OF THE INVENTION

Briefly, the present invention may be described as an internal combustion engine comprising cylinder block means, fuel intake port means for the engine, carburetor means including throttle valve means, crankshaft means and speed control means including means for receiving a set speed signal and for sensing the speed of said crankshaft means, said speed control means being operative to automatically adjust the position of the throttle valve means in accordance with a comparison of said set speed signal and said speed of the crankshaft means. In accordance with the invention, the fuel intake port means are defined to be located within the cylinder block means and the throttle valve means are located within the fuel intake port means.

As a result of the solution of the invention, it is possible not only to construct a mechanism having significantly simpler adjusting elements between the control means and the throttle valve means, but also the adjustment of the throttle valve shaft of the throttle valve means can now be effected directly by the control means. The innovation of the present invention makes it possible in an internal combustion engine to construct the carburetor control arrangement so as to be completely enclosed without additional components whereby impairment of the arrangement due to dust, dirt or mechanical damage is reliably avoided. Moreover, the carburetor or the carburetor housing may now be of a simpler construction and may be manufactured from materials, such as plastic or the like, which can be processed less expensively.

The various features of novelty which characterize the invention are pointed out with particularity in the claims annexed to and forming a part of this disclosure. For a better understanding of the invention, its operating advantages and specific objects attained by its use, reference should be had to the accompanying drawing and descriptive matter in which there is illustrated and described a preferred embodiment of the invention.

DESCRIPTION OF THE DRAWING

The single FIGURE drawing appearing in the application is a cross-sectional view showing part of the cylinder block and crankcase of an internal combustion engine embodying the present invention.

DETAILED DESCRIPTION OF THE PREFERRED EMBODIMENT

Referring to the drawing, there is shown the upper portion of a crankcase of an internal combustion engine which is denoted by reference numeral 10 with the lower portion being denoted by reference numeral 12. A crankshaft 14 is rotatably supported in the crankcase 10,12. In the embodiment depicted, the upper portion 10 of the crankcase 10,12 is constructed in one piece with a cylinder block 16 which is provided with a cylinder bore 18. The upper portion of the cylinder bore 18 connects to a spark plug duct 20 and an intake port 22 connects laterally at the cylinder bore 18. The intake port 22 is formed by a bore in the cylinder block 16 extending perpendicularly to the cylinder axis 36. Connected to the intake port 22 is a carburetor assembly 24 which is flanged to the cylinder block 16 by means of screw bolts 26.

The cylinder bore 18 further connects to an exhaust port 28. The embodiment shown in the drawing is a two-stroke carburetor internal combustion engine wherein the piston, the connecting rod and the crank connecting the connecting rod with the crankshaft 14 are not illustrated for the sake of clarity.

In the intake port 22 which has an approximately circular cross-section, there is supported a throttle valve 30 so as to be pivotable about an axis 32. The throttle valve 30 is constructed as a disk with an approximately circular periphery whose diameter approximately corresponds to the internal diameter of the intake port 22. The throttle valve 30 is rigidly arranged on a pivot shaft 34 which is parallel to the axis 36 of the cylinder bore. The pivot shaft 34 is rotatably supported in a bearing bore 38 of the cylinder block 16. In the interior 40 of the crankcase 10,12 there is arranged a control means 42 which is only schematically illustrated. This control means 42 serves to maintain the speed of the internal combustion engine at a predetermined level which may be adjusted by a manual actuation device 44.

The control means 42 operates on the basis of a desired value/actual value comparison. It compares the actual value of the speed of the crankshaft 14 with a desired value given by the adjustment of the manual actuation device 44. From this desired value/actual value comparison, a differential signal is generated which effects the adjustment of the throttle valve 30. The differential signal is developed by means of two bolts 46 which comprise part of the control means 42 and which can be moved axially in the direction of the axis 48 of the crankshaft 4, wherein the magnitude of the axial movement represents the differential signal.

For transmitting the differential signal to the throttle valve 30, an adjusting lever 50 is arranged on the cylinder block 16 so as to be pivotable about a pin 52. The pin 52 is arranged parallel to the axis 36 of the cylinder bore 18. Pockets 54 define oblong holes 56 into which the bolts 46 engage.

At the free end of the adjusting lever 50, there is arranged a lug 58 which engages into a fork 60 of a driver 62. The driver 62 is fastened on the free end of the pivot shaft 34. When the control 42 delivers a differential signal, i.e. when the bolts 46 are moved in the direction of the crankshaft axis 48, these bolts 46 swing the adjusting lever 50 about the pin 52. The swinging movement of the adjusting lever 50 is transmitted over the lug 58 and the fork 60 of the driver 62 to the pivot shaft 34, so that the throttle valve 30 is rotated whereby the throttling cross-section of the intake port 22 is changed.

It is an essential aspect of the concept of the invention that the mechanical transmission members which transmit the differential signal generated by the control means 42 to the throttle valve 30 are arranged completely protected within the cylinder block 16 and the crankcase 10,12.

Of course, the invention can also be employed when the cylinder block 16 is flanged onto the upper portion of the crankcase, in which case, the pivot shaft 34 can extend through the joint where the cylinder block 16 and the upper portion 10 of the crankcase 10,12 abut.

The control means 42 may be a centrifugal governor as is described, for example, in British Pat. No. 872,690.

While a specific embodiment of the invention has been shown and described in detail to illustrate the application of the inventive principles, it will be understood that the invention may be embodied otherwise without departing from such principles.

What is claimed is:

1. In an internal combustion engine including cylinder block means defining integrally therewith intake port means, crankcase means defining a cavity receiving a crankshaft, a carburetor mechanism attached to said cylinder block means in flow communication with said intake port means, throttle valve means within said intake port means, control means for controlling said throttle valve means, and mechanical transmission means connecting said control means and said throttle valve means, the improvement comprising that said control means are housed completely within said cavity of said crankcase means and are responsive to the number of revolutions of said crankshaft, said transmission means being arranged through a passage within said cylinder block means toward said cavity such that all of the parts of said transmission means and said control means are located completely within the interior of said cylinder block means and said cavity.

2. An internal combustion engine according to claim 1 wherein said throttle valve means include a throttle valve and a pivot shaft supported in said cylinder block means and wherein said pivot shaft connected to said throttle valve is rotatably supported in a bore of said cylinder block means which extends essentially parallel to the axis of a cylinder bore defined by said cylinder block means, said pivot shaft projecting at one end thereof facing away from said throttle valve into the interior of said crankcase means being connected to said control means through an actuating linkage.

3. An internal combustion engine according to claim 2 wherein said actuating linkage comprises an adjusting lever arranged so as to be pivotable about a pin which is parallel to the axis of said cylinder bore, said adjusting lever being connected through a first bolt and oblong hole connection to said control means and through a second bolt and oblong hole connection to said pivot shaft of said throttle valve, said adjusting lever and said bolt and oblong hole connections being accommodated completely within the interior of said crankcase means.

* * * * *